US010756423B2

(12) United States Patent
Huang et al.

(10) Patent No.: US 10,756,423 B2
(45) Date of Patent: Aug. 25, 2020

(54) DUAL BAND ANTENNA MODULE

(71) Applicant: PEGATRON CORPORATION, Taipei (TW)

(72) Inventors: Ke-Chin Huang, Taipei (TW); Jung-Yi Huang, Taipei (TW); Hui-An Yang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 224 days.

(21) Appl. No.: 16/104,115

(22) Filed: Aug. 16, 2018

(65) Prior Publication Data

US 2019/0115654 A1 Apr. 18, 2019

(30) Foreign Application Priority Data

Oct. 16, 2017 (TW) ..... 106135274 A

(51) Int. Cl.
*H01Q 1/52* (2006.01)
*H01Q 5/35* (2015.01)
(Continued)

(52) U.S. Cl.
CPC ..... *H01Q 1/523* (2013.01); *H01Q 1/521* (2013.01); *H01Q 5/35* (2015.01); *H01Q 5/40* (2015.01); *H01Q 5/50* (2015.01); *H01Q 9/40* (2013.01); *H01Q 9/42* (2013.01); *H01Q 21/0025* (2013.01); *H01Q 21/28* (2013.01); *H01Q 1/2291* (2013.01); *H01Q 1/48* (2013.01); *H01Q 5/30* (2015.01); *H01Q 9/04* (2013.01)

(58) Field of Classification Search
CPC ..... H01Q 1/38–1/52; H01Q 5/30–5/50; H01Q 9/0407; H01Q 21/28
See application file for complete search history.

(56) References Cited

U.S. PATENT DOCUMENTS 5,936,594 A 8/1999 Yu et al.
6,957,080 B2 10/2005 Guetre et al.
(Continued)

FOREIGN PATENT DOCUMENTS

CN 101443957 5/2009
KR 20080094530 10/2008
(Continued)

OTHER PUBLICATIONS

"Search Report of Europe Counterpart Application", dated Mar. 8, 2019, p. 1-p. 8.

*Primary Examiner* — Dameon E Levi
*Assistant Examiner* — Hasan Z Islam
(74) *Attorney, Agent, or Firm* — J.C. Patents

(57) ABSTRACT

A dual band antenna module including a first radiator, a second radiator, a first filter and a second filter is provided. The first radiator resonates to generate a first frequency band and includes a first feeding end and a first ground end. The second radiator resonates to generate a second frequency band and includes a second feeding end and a second ground end. The first filter is extended from the first feeding end in a direction away from the first radiator and used for filtering the second frequency band. The second filter is extended from the second feeding end in a direction away from the second radiator and used for filtering the first frequency band.

9 Claims, 6 Drawing Sheets

(51) Int. Cl.

| | |
|---|---|
| ***H01Q 9/40*** | (2006.01) |
| ***H01Q 21/28*** | (2006.01) |
| ***H01Q 5/40*** | (2015.01) |
| ***H01Q 9/42*** | (2006.01) |
| ***H01Q 5/50*** | (2015.01) |
| ***H01Q 21/00*** | (2006.01) |
| *H01Q 1/22* | (2006.01) |
| *H01Q 5/30* | (2015.01) |
| *H01Q 9/04* | (2006.01) |
| *H01Q 1/48* | (2006.01) |

(56) References Cited

U.S. PATENT DOCUMENTS

| | | | | |
|---|---|---|---|---|
| 7,411,554 | B2 * | 8/2008 | Jung | H01Q 1/243 343/700 MS |
| 7,450,072 | B2 | 11/2008 | Kim et al. | |
| 7,605,760 | B2 | 10/2009 | Kim et al. | |
| 8,059,046 | B2 | 11/2011 | Nysen | |
| 2003/0119457 | A1 | 6/2003 | Standke | |
| 2004/0189530 | A1 | 9/2004 | Chung et al. | |
| 2007/0229366 | A1 | 10/2007 | Kim et al. | |
| 2008/0258977 | A1 * | 10/2008 | Kim | H01Q 1/38 343/700 MS |
| 2009/0189824 | A1 * | 7/2009 | Nishikido | H01Q 1/242 343/826 |
| 2011/0163922 | A1 | 7/2011 | Wang et al. | |
| 2013/0222186 | A1 | 8/2013 | Leung et al. | |
| 2015/0295311 | A1 | 10/2015 | Bringuier et al. | |
| 2016/0294048 | A1 | 10/2016 | Xu et al. | |
| 2017/0012345 | A1 | 1/2017 | Zhang et al. | |
| 2017/0250471 | A1 * | 8/2017 | Lee | H01Q 9/0407 |

FOREIGN PATENT DOCUMENTS

| | | |
|---|---|---|
| KR | 20080112346 | 12/2008 |
| KR | 20160017750 | 2/2016 |
| TW | I403026 | 7/2013 |

* cited by examiner

DUAL BAND ANTENNA MODULE

CROSS-REFERENCE TO RELATED APPLICATION

This application claims the priority benefit of Taiwan application serial no. 106135274, filed on Oct. 16, 2017. The entirety of the above-mentioned patent application is hereby incorporated by reference herein and made a part of this specification.

BACKGROUND

Technology Field

The invention relates to an antenna module, and particularly relates to a dual band antenna module.

Description of Related Art

In current wireless transmission systems, dual band systems (for example, including a bandwidth of 2.4G and a bandwidth of 5G, both) are commonly seen. In antenna designs of the dual band systems, one of the designs uses two single band antennas, but such designs often face the problem of poor signal isolation between the two single band antennas. The distance between the two antennas is usually increased to boost the signal isolation, but increasing the distance between the two antennas will increase the overall size of the antenna and make it difficult to downsize the overall system. Another design is to use a diplexer with the dual band antennas to divide the different band signals. However, since the dual band antennas require a diplexer, the overall price will also be higher.

SUMMARY

The invention provides a dual band antenna module with a good isolation in the different bands, a smaller size and a lower cost.

The dual band antenna module of the invention includes a first radiator, a second radiator, a first filter and a second filter. The first radiator includes a first feeding end and a first ground end. The first radiator resonates to generate a first frequency band. The second radiator includes a second feeding end and a second ground end. The second radiator resonates to generate a second frequency band. The first filter is extended from the first feeding end in a direction away from the first radiator and used for filtering the second frequency band. The second filter is extended from the second feeding end in a direction away from the second radiator and used for filtering the first frequency band.

In an exemplary embodiment of the invention, the foregoing dual band antenna module further includes a first ground pattern and a second ground pattern. The first ground end is connected to the first ground pattern. The second ground end is connected to the second ground pattern. The first ground pattern and the second ground pattern are located between the first radiator and the second radiator, respectively.

In an exemplary embodiment of the invention, the foregoing dual band antenna module further includes a carrier board, a third ground pattern and a plurality of through holes. The carrier board includes a first surface and a second surface opposite each other, wherein the first ground pattern and the second ground pattern are configured on the first surface. The third ground pattern is configured on the second surface. The plurality of through holes penetrates the carrier board. Some of the through holes are connected to the first ground pattern and the third ground pattern, and some of the through holes are connected to the second ground pattern and the third ground pattern.

In an exemplary embodiment of the invention, the foregoing first ground pattern and the second ground pattern are located in a middle region of the first surface, the first radiator and the second radiator are extended in a direction away from the middle region on the first surface, the first filter is extended from the first feeding end to the middle region, and the second filter is extended from the second feeding end to the middle region.

In an exemplary embodiment of the invention, the foregoing through holes connected to the first ground pattern and the third ground pattern are arranged along the outer edges of the first ground pattern, and the through holes connected to the second ground pattern and the third ground pattern are arranged along the outer edges of the second ground pattern.

In an exemplary embodiment of the invention, the foregoing first ground pattern has a notch, and the first filter is extended into the notch.

In an exemplary embodiment of the invention, the foregoing first ground pattern and the second ground pattern have corresponding outlines, and the second filter extends along the outline of the first ground pattern and the outline of the second ground pattern and between the first ground pattern and the second ground pattern.

In an exemplary embodiment of the invention, a length of the foregoing first filter is ¼ wavelength of the second frequency band, and a length of the second filter is ¼ wavelength of the first frequency band.

In an exemplary embodiment of the invention, the foregoing first frequency band is between 2400 MHz and 2500 MHz, and the second frequency band is between 5150 MHz and 5850 MHz.

Based on the foregoing descriptions, the dual band antenna module of the invention uses the first radiator and the second radiator to resonate and generate the first frequency band and the second frequency band. The first filter is designed at the first feeding end of the first radiator to filter the second frequency band. The second filter is designed at the second feeding end of the second radiator to filter the first frequency band. That achieves a good isolation between the first frequency band and the second frequency band. In this way, it is not necessary for the first radiator and the second radiator to be far apart from each other and the dual band antenna module can be in a smaller size. In addition, since the dual band antenna module of the invention does not require a diplexer, and therefore the cost is lower.

To make the aforementioned more comprehensible, several embodiments accompanied with drawings are described in detail as follows.

DETAILED DESCRIPTION

Figure 1:
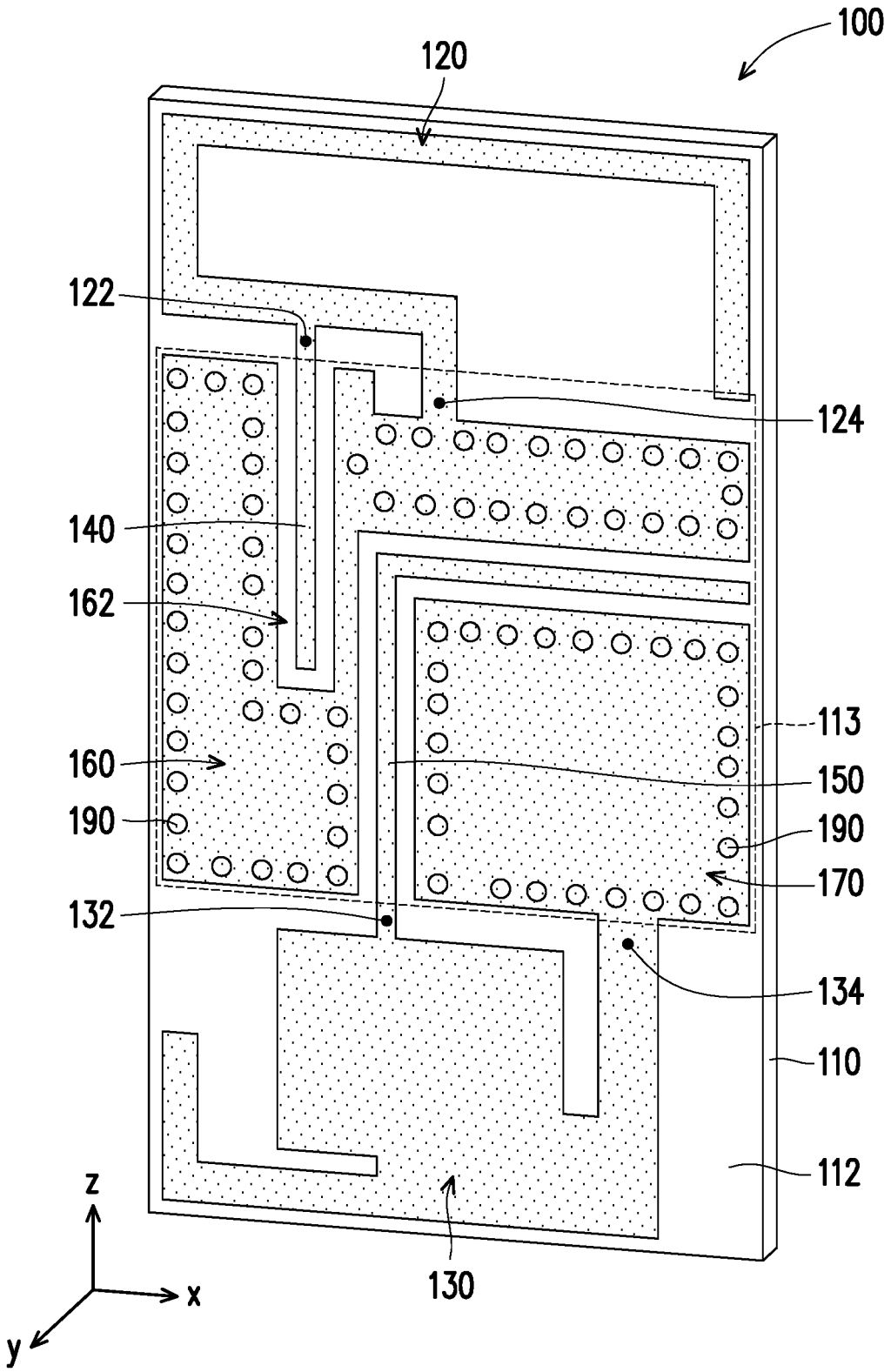
FIG. 1 is a schematic perspective view of a dual band antenna module according to an exemplary embodiment of the invention.
Figure 2:
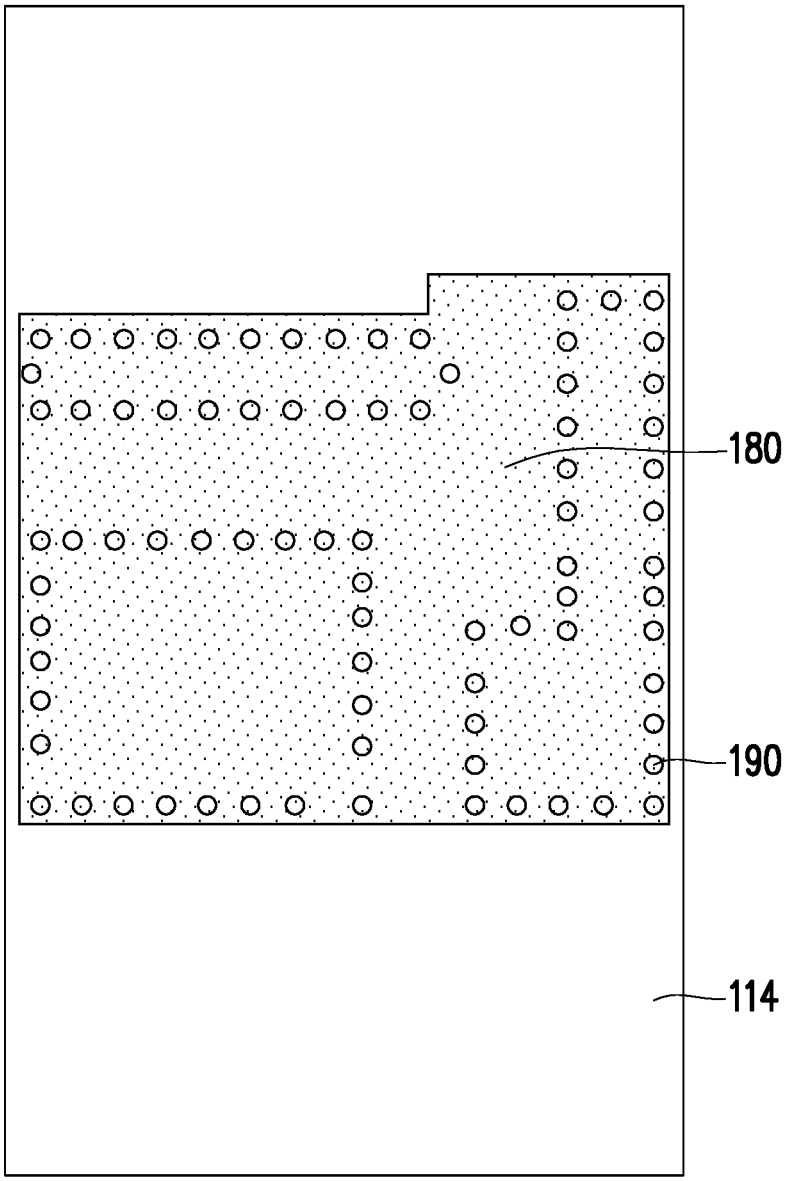
FIG. 2 is a schematic rear view of the dual band antenna module of FIG. 1.

FIG. 1 is a schematic perspective view of a dual band antenna module according to an exemplary embodiment of the invention. FIG. 2 is a schematic rear view of the dual band antenna module of FIG. 1. Referring to both FIG. 1 and FIG. 2, a dual band antenna module 100 of the exemplary embodiment includes a carrier board 110, a first radiator 120, a second radiator 130, a first filter 140, a second filter 150, a first ground pattern 160, and a second ground pattern 170. The carrier board 110 includes a first surface 112 and a second surface 114 (marked in FIG. 2) opposite each other. As shown in FIG. 1, the first radiator 120, the second radiator 130, the first filter 140 and the second filter 150, the first ground pattern 160 and the second ground pattern 170 are configured on the first surface 112 of the carrier board 110. Certainly, in other exemplary embodiments, the dual band antenna module 100 may omit the carrier board 110 and form directly on a case of an electronic device.

As shown in FIG. 1, the first radiator 120 includes a first feeding end 122 and a first ground end 124. The first ground end 124 is connected to the first ground pattern 160. The second radiator 130 includes a second feeding end 132 and a second ground end 134. The second ground end 134 is connected to the second ground pattern 170.

In the exemplary embodiment, the first ground pattern 160 and the second ground pattern 170 are located between the first radiator 120 and the second radiator 130, respectively. To be more specific, the first ground pattern 160 and the second ground pattern 170 are located in a middle region 113 of the first surface 112 of the carrier board 110, and the first radiator 120 and the second radiator 130 extend in a direction away from the middle region 113 on the first surface 112. In the exemplary embodiment, the first radiator 120 is located on an upper side of the middle region 113, and the second radiator 130 is located on a lower side of the middle region 113. Certainly, the relative location of the first radiator 120 and the second radiator 130 is not limited thereto, as long as the first radiator 120 and the second radiator 130 are away from each other.

In addition, as shown in FIG. 2, in the exemplary embodiment, the dual band antenna module 100 further includes a third ground pattern 180 and a plurality of through holes 190. The third ground pattern 180 is configured on the second surface 114 corresponding to the locations of the first ground pattern 160 and the second ground pattern 170. The first ground pattern 160 and the third ground pattern 180 are connected through some of the through holes 190 penetrating the carrier board 110, and the second ground pattern 170 and the third ground pattern 180 are connected through some of the through holes 190 penetrating the carrier board 110.

As shown in FIG. 1 and FIG. 2, in the exemplary embodiment, the through holes 190 connected to the first ground pattern 160 and the third ground pattern 180 are arranged along the outer edges of the first ground pattern 160, and the through holes 190 connected to the second ground pattern 170 and the third ground pattern 180 are arranged along the outer edges of the second ground pattern 170. Certainly, in other exemplary embodiments, the through holes 190 may be located off the edges of the first ground pattern 160 and the second ground pattern 170, and the configured location and arrangement of the through holes 190 are not limited thereto. Certainly, in other exemplary embodiments, if an area of the first ground pattern 160 and the second ground pattern 170 is sufficient, the dual band antenna module 100 may also omit the third ground pattern 180 and the through holes 190.

In the exemplary embodiment, the first radiator 120 of the dual band antenna module 100 resonates to generate a first frequency band. The second radiator 130 resonates to generate a second frequency band. In the exemplary embodiment, a bandwidth of the first frequency band is 2.4 G bandwidth, which is approximately between 2400 MHz and 2500 MHz, and a bandwidth of the second frequency band is 5G bandwidth, which is approximately between 5150 MHz and 5850 MHz. Certainly, in other exemplary embodiments, the first frequency band and the second frequency band may have other bandwidth ranges, and the bandwidth ranges of the first frequency band and the second frequency band are not limited thereto.

It is worth mentioning that, in general, the problem with the dual band antenna structure is the signal interference caused by the energy between the two antennas. Therefore, it is necessary to keep a certain degree of isolation between the two antennas in order to obtain good signals in each of the two frequency bands. In the exemplary embodiment, the first filter 140 and the second filter 150 are specially designed. In this way, the dual band antenna module 100 may effectively increase the isolation between the first frequency band and the second frequency band on the premise that the dual band antenna module 100 is small-sized and low-cost. In other words, even though the dual band antenna module 100 is limited in size and the first radiator 120 and the second radiator 130 are relatively close, the first filter 140 and the second filter 150 may still have a good isolation between the first frequency band generated by the first radiator 120 and the second frequency band generated by the second radiator 130.

As shown in FIG. 1, in the exemplary embodiment, the first filter 140 extends from the first feeding end 122 of the first radiator 120, and extends in a direction away from the first radiator 120, and reaches into the middle region 113. In the exemplary embodiment, the first ground pattern 160 located in the middle region 113 has a notch 162, and the first filter 140 extends into the notch 162. The first filter 140 is used for filtering electromagnetic waves of the second frequency band. In the exemplary embodiment, a length of the first filter 140 is ¼ wavelength of the second frequency band.

Similarly, the second filter 150 extends from the second feeding end 132 in a direction away from the second radiator 130 and towards the middle region 113. In the exemplary embodiment, the first ground pattern 160 and the second ground pattern 170 have corresponding outlines such that the second filter 150 extends along the outline of the first ground pattern 160 and the outline of the second ground pattern 170 and between the first ground pattern 160 and the second ground pattern 170. The second filter 150 is used for filtering electromagnetic waves of the first frequency band. In the exemplary embodiment, a length of the second filter 150 is ¼ wavelength of the first frequency band.

In other words, the dual band antenna module 100 of the exemplary embodiment uses the first radiator 120 and the second radiator 130 to generate the first frequency band and the second frequency band, respectively, and the first filter 140 at the first feeding end 122 of the first radiator 120 and the second filter 150 at the second feeding end 132 of the second radiator 130 are designed to filter the second frequency band and the first frequency band, respectively. That achieves a good isolation between the first frequency band and the second frequency band. In this way, since it is not necessary for the first radiator 120 and the second radiator 130 to be far apart from each other, the dual band antenna module 100 can go smaller. In addition, the dual band antenna module 100 does not require a frequency divider and therefore the cost is reduced.

Figure 3:
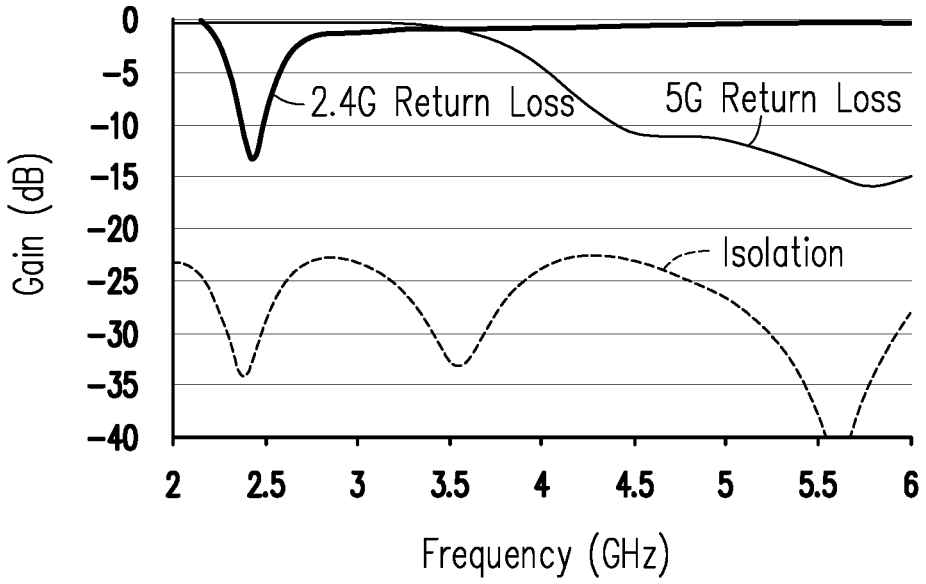
FIG. 3 is a plot of a frequency vs. return loss and isolation of the dual band antenna module of FIG. 1.

FIG. 3 is a plot of a frequency vs. return loss and isolation of the dual band antenna module 100 of FIG. 1. Referring to FIG. 3, as seen in the simulation, the dual band antenna module 100 of FIG. 1, in the 2.4G band (x-axis is approximately between 2.4 GHz to 2.55 GHz) and 5G band (x-axis is approximately between 5.6 GHz and 6 GHz), has a return loss that is both lower than −10 gain (dB) and has better return loss performance. In addition, not only does the dual band antenna module 100 of FIG. 1 have an isolation that is less than −20 gain (dB) in all bands, but also the dual band antenna module 100 has a lower value in the 2.4G band and the 5G band, representing a better isolation performance in the 2.4G band and the 5G band.

Figure 4:
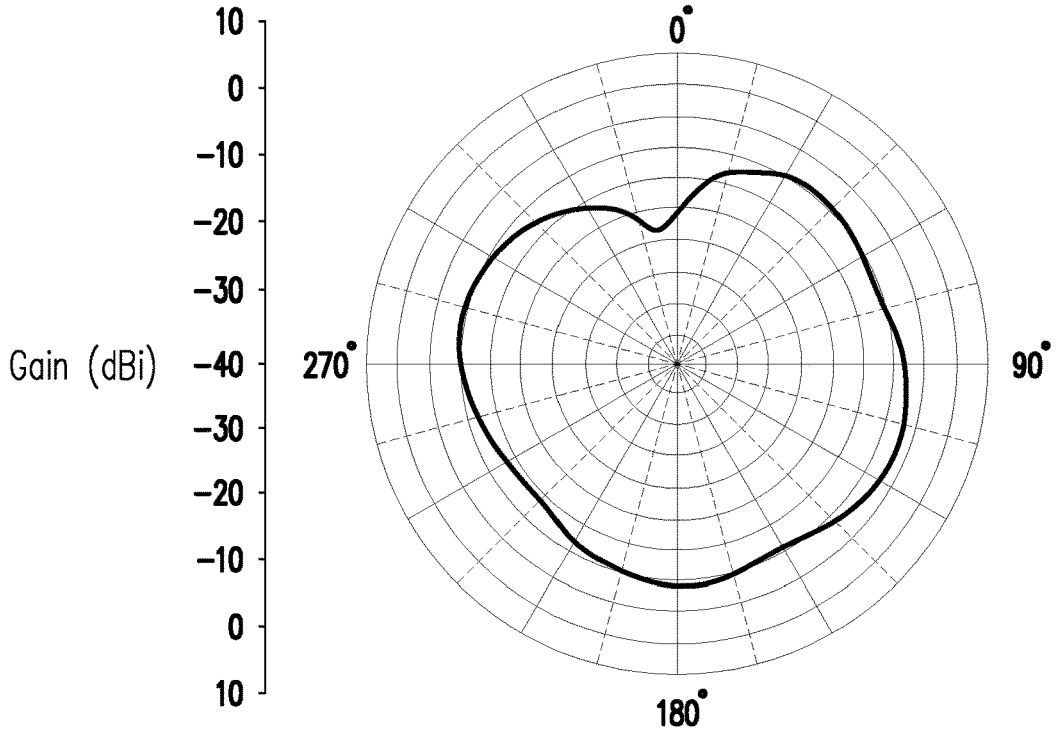
FIG. 4 to FIG. 6 are radiation patterns of the dual band antenna module of FIG. 1 on a X-Z plane, a Y-Z plane, and a X-Y plane in a first frequency band.
Figure 5:
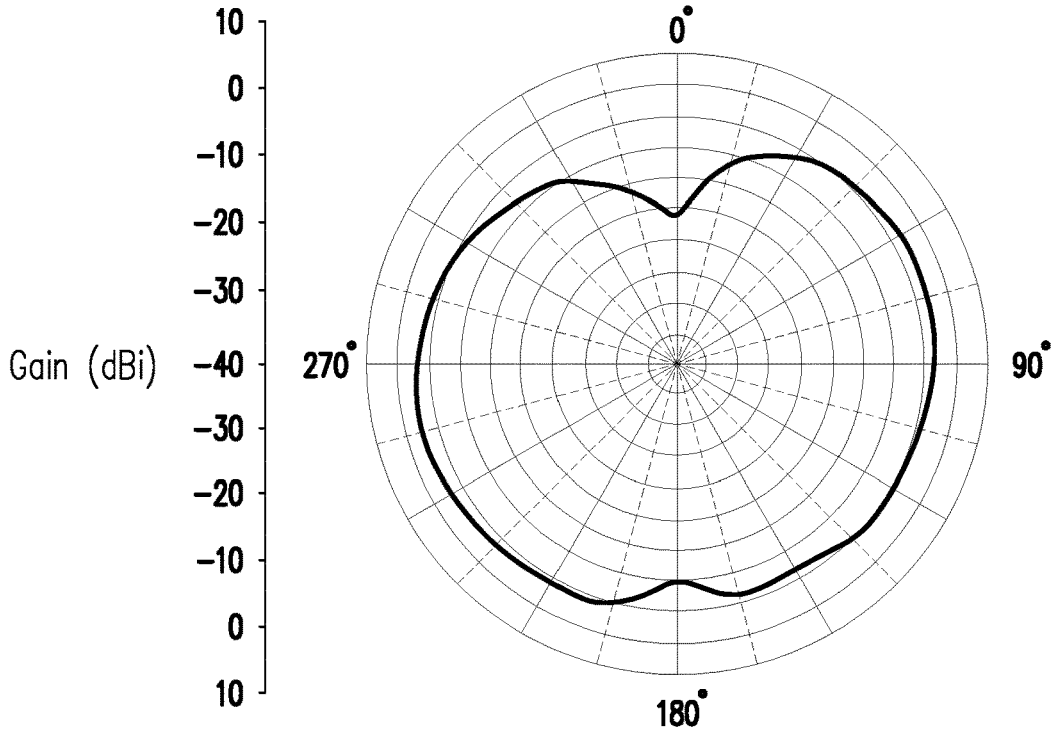
Figure 6:
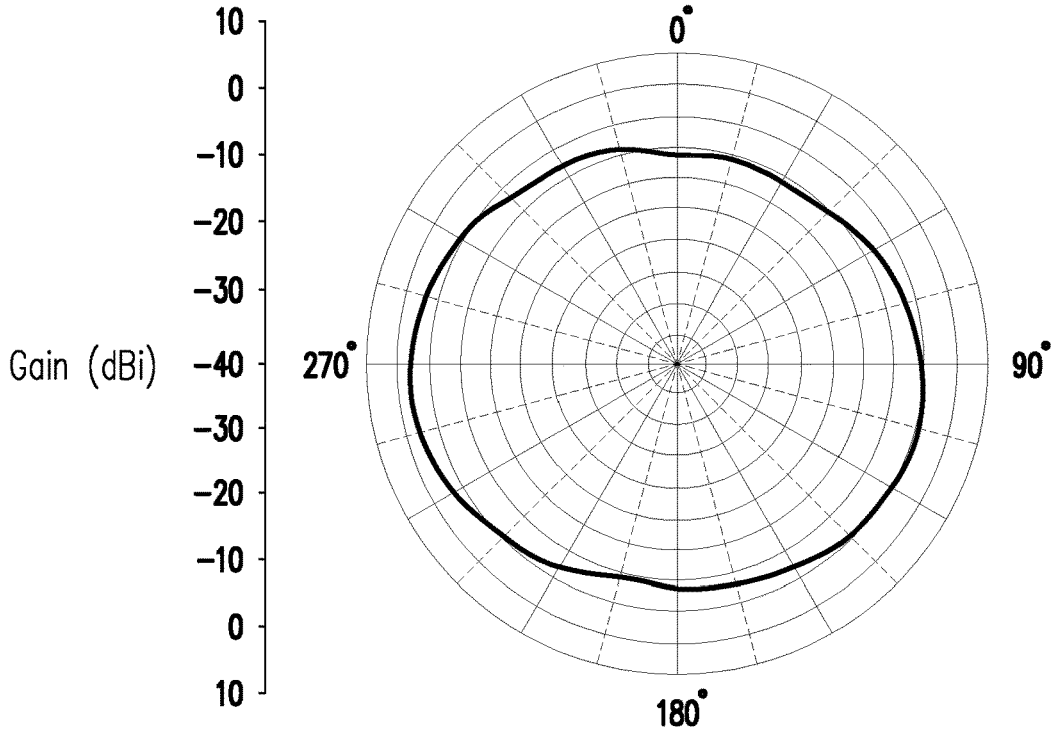

FIG. 4 to FIG. 6 are radiation patterns of the first frequency band generated by the dual band antenna module 100 of FIG. 1 on a X-Z plane, a Y-Z plane, and a X-Y plane. It is noted that FIG. 4 to FIG. 6 show the radiation gain value of the first frequency band at different angles (360 degrees) on the X-Z plane, the Y-Z plane, and the X-Y plane when the dual band antenna module 100 in FIG. 1 is placed at an origin of X-Y-Z three dimensional coordinates. In other words, on the X-Z plane, the Y-Z plane, and the X-Y plane, the radiation gain of the first frequency band is measured 360 degrees with the dual band antenna module 100 as center, to form radiation fields shown in FIG. 4 to FIG. 6.

Referring to FIG. 4 to FIG. 6, the radiation patterns of the dual band antenna module 100 of FIG. 1 on the X-Z plane, the Y-Z plane, and the X-Y plane are close to the radiation pattern of one single band antenna generating the 2.4G band in general, and also close to the radiation pattern of a dual band antenna having a diplexer in the 2.4G band in general. In other words, the first filter 140 of the dual band antenna module 100 of the exemplary embodiment may effectively isolate the second frequency band so that the first frequency band (for example, the 2.4G band) generated by the first radiator 120 can have a good performance close to the single band antenna or the dual band antenna having the diplexer. In addition, as seen from Table 1 below, the antenna efficiency of the first frequency band (for example, 2.4G band, between 2400 MHz to 2500 MHz) generated by the first radiator 120 of the dual band antenna module 100 are all above 60%, and has good antenna performance.

TABLE 1

| | X-Z plane | | Y-Z plane | | X-Y plane | | | |
|---|---|---|---|---|---|---|---|---|
| Frequency (MHz) | Peak gain (dBi) | Average gain (dBi) | Peak gain (dBi) | Average gain (dBi) | Peak gain (dBi) | Average gain (dBi) | Maximum gain (dBi) | Antenna Efficiency (%) |
| 2400 | 3.10 | −3.52 | 1.06 | −0.86 | 0.85 | −2.55 | 3.31 | 69 |
| 2450 | 2.62 | −3.64 | 1.14 | −0.73 | 0.35 | −2.54 | 2.63 | 70 |
| 2500 | 1.75 | −3.76 | 1.03 | −0.72 | 0.86 | −2.38 | 2.00 | 69 |

Figure 7:
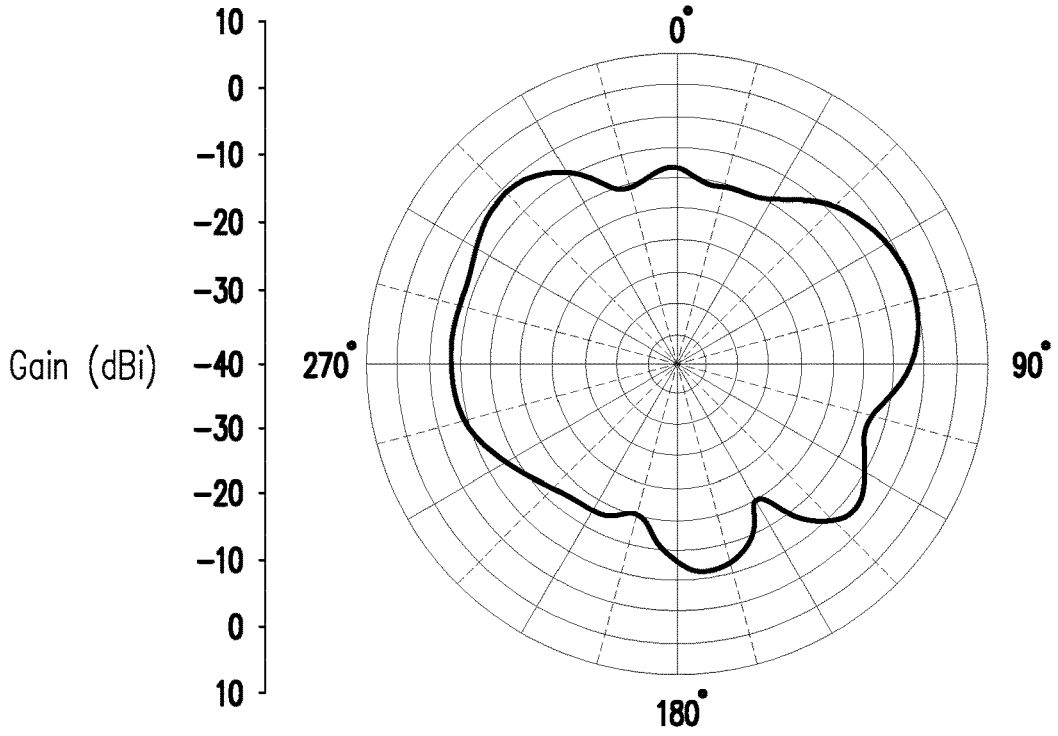
FIG. 7 to FIG. 9 are radiation patterns of the dual band antenna module of FIG. 1 on a X-Z plane, a Y-Z plane, and a X-Y plane in a second frequency band.
Figure 8:
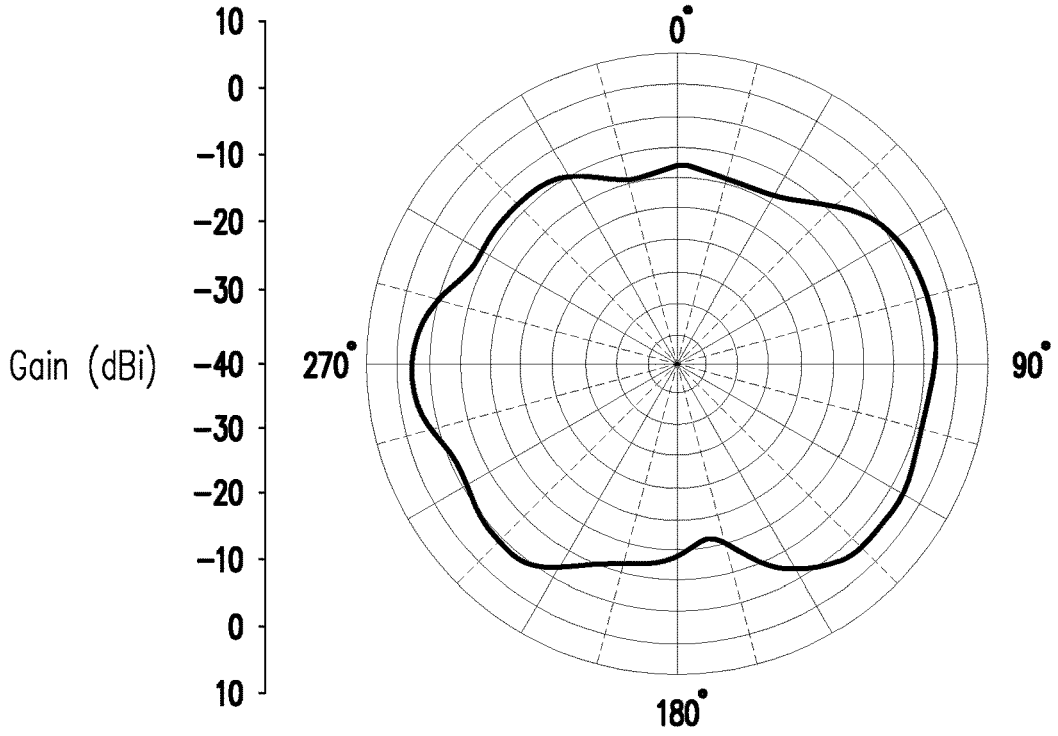
Figure 9:
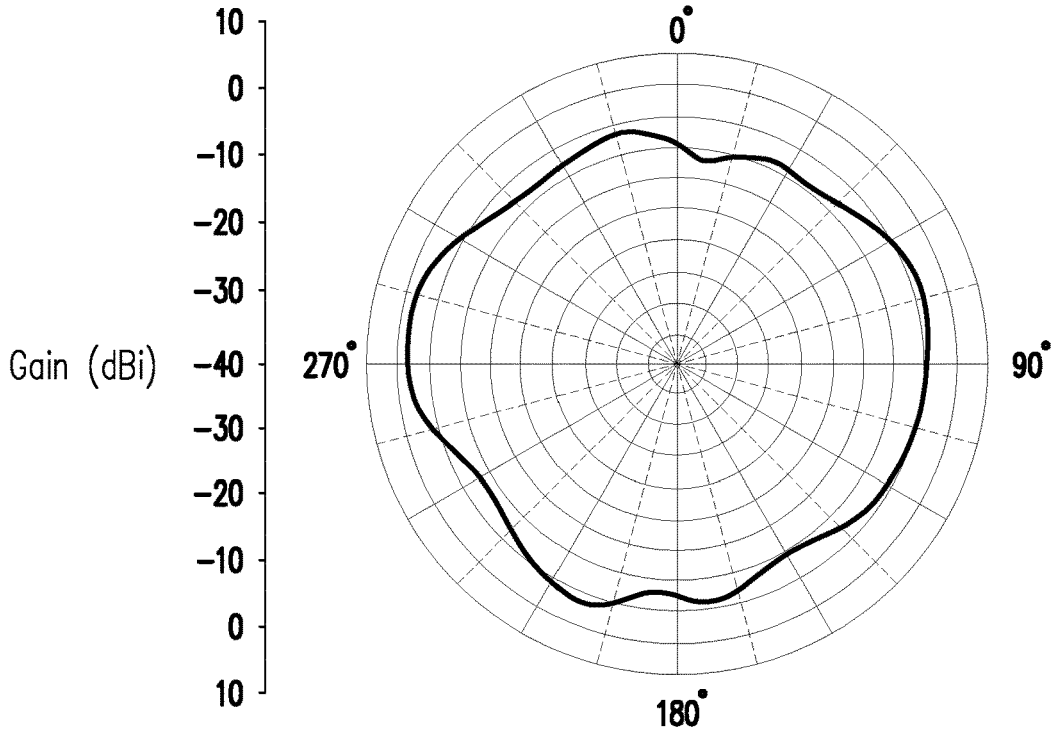

FIG. 7 to FIG. 9 are the radiation patterns of a second frequency band generated by the dual band antenna module 100 of FIG. 1 on a X-Z plane, a Y-Z plane, and a X-Y plane. Similarly, FIG. 7 to FIG. 9 show the radiation gain value of the second frequency band at different angles (360 degrees) on the X-Z plane, the Y-Z plane, and the X-Y plane when the dual band antenna module 100 in FIG. 1 is placed at an origin of X-Y-Z three dimensional coordinates. In other words, on the X-Z plane, the Y-Z plane, and the X-Y plane, the radiation gain of the second frequency band is measured 360 degrees with the dual band antenna module 100 as center, to form radiation fields shown in FIG. 7 to FIG. 9.

Referring to FIG. 7 to FIG. 9, the radiation patterns of the dual band antenna module 100 of FIG. 1 on the X-Z plane, the Y-Z plane, and the X-Y plane are close to the radiation pattern of one single band antenna generating the 5G band in general, and also close to the radiation pattern of a dual band antenna having a diplexer in general in the 5G band. In other words, the second filter 150 of the dual band antenna module 100 of the exemplary embodiment may effectively isolate the first frequency band so that the second frequency band generated by the second radiator 130 can have a good performance close to the single band antenna or the dual band antenna having the diplexer. In addition, as seen from Table 2 below, the antenna efficiency of the second frequency band (for example, 5G band, between 5150 MHz to 5850 MHz) generated by the second radiator 130 of the dual band antenna module 100 are all above 60%, and has good antenna performance.

TABLE 2

| Frequency (MHz) | X-Z plane Peak gain (dBi) | X-Z plane Average gain (dBi) | Y-Z plane Peak gain (dBi) | Y-Z plane Average gain (dBi) | X-Y plane Peak gain (dBi) | X-Y plane Average gain (dBi) | Maximum gain (dBi) | Antenna Efficiency (%) |
|---|---|---|---|---|---|---|---|---|
| 5150 | −1.35 | −6.98 | 1.47 | −1.54 | 0.78 | −3.01 | 1.95 | 62 |
| 5350 | −2.19 | −6.82 | 2.16 | −1.45 | 1.34 | −3.05 | 2.28 | 64 |
| 5450 | −2.73 | −7.49 | 2.51 | −1.56 | 2.00 | −3.19 | 3.14 | 63 |
| 5725 | −2.77 | −7.62 | 2.62 | −2.06 | 0.06 | −4.54 | 2.62 | 61 |
| 5850 | −2.84 | −7.22 | 2.27 | −1.47 | −0.32 | −3.61 | 2.31 | 63 |

Therefore, the design of the first filter 140 and the second filter 150 of the dual band antenna module 100 of the exemplary embodiment reduces the distance between the first radiator 120 and the second radiator 130 and the overall size. In the exemplary embodiment, a type of the first radiator 120 and the second radiator 130 may be, for example, a planar inverted-F antenna (FIFA Antenna) to reduce the size of the dual band antenna module 100. To be more specific, a length, width and height of the dual band antenna module 100 may be reduced to 27.5 mm, 16 mm and 0.6 mm. Certainly, the type of the first radiator 120 and the second radiator 130 and the length, width and height of the dual band antenna module 100 are also not limited thereto.

Based on the foregoing, the dual band antenna module of the invention uses the first radiator and the second radiator to resonate and generate the first frequency band and the second frequency band, respectively, and the first filter at the first feeding end of the first radiator is designed to filter the second frequency band, and the second filter at the second feeding end of the second radiator is designed to filter the first frequency band. That achieves a good isolation between the first frequency band and the second frequency band. In this way, since it is not necessary for the first radiator and the second radiator to be far apart from each other, the dual band antenna module can go smaller in size. In addition, since the dual band antenna module of the invention does not require a diplexer, the cost is lowered.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A dual band antenna module comprising:

a first radiator comprising a first feeding end and a first ground end, wherein the first radiator resonates to generate a first frequency band;

a second radiator comprising a second feeding end and a second ground end, wherein the second radiator resonates to generate a second frequency band;

a first filter extended from the first feeding end in a direction away from the first radiator and used for filtering the second frequency band; and a second filter extended from the second feeding end in a direction away from the second radiator and used for filtering the first frequency band.

2. The dual band antenna module according to claim 1, further comprising:

a first ground pattern, connected to the first ground end; and a second ground pattern, connected to the second ground end, wherein the first ground pattern and the second ground pattern are located between the first radiator and the second radiator, respectively.

3. The dual band antenna module according to claim 2, further comprising:

a carrier board comprising a first surface and a second surface opposite each other, wherein the first ground pattern and the second ground pattern are configured on the first surface;

a third ground pattern configured on the second surface; and a plurality of through holes penetrating the carrier board, wherein some of the through holes are connected to the first ground pattern and the third ground pattern, some of the through holes are connected to the second ground pattern and the third ground pattern.

4. The dual band antenna module according to claim 3, wherein the first ground pattern and the second ground pattern are located in a middle region of the first surface, the first radiator and the second radiator are extended in a direction away from the middle region on the first surface, the first filter is extended from the first feeding end to the middle region, and the second filter is extended from the second feeding end to the middle region.

5. The dual band antenna module according to claim 3, wherein the through holes connected to the first ground pattern and the third ground pattern are arranged along the outer edges of the first ground pattern, and the through holes connected to the second ground pattern and the third ground pattern are arranged along the outer edges of the second ground pattern.

6. The dual band antenna module according to claim 2, wherein the first ground pattern has a notch, and the first filter is extended into the notch.

7. The dual band antenna module according to claim 2, wherein the first ground pattern and the second ground pattern have corresponding outlines, and the second filter extends along the outline of the first ground pattern and the outline of the second ground pattern and between the first ground pattern and the second ground pattern.

8. The dual band antenna module according to claim 1, wherein a length of the first filter is ¼ wavelength of the second frequency band, and a length of the second filter is ¼ wavelength of the first frequency band.

9. The dual band antenna module according to claim 1, wherein the first frequency band is between 2400 MHz and 2500 MHz, and the second frequency band is between 5150 MHz and 5850 MHz.

* * * * *